United States Patent [19]
Sundstrom

[11] 4,186,574
[45] Feb. 5, 1980

[54] FABRIC SOFTENER DISPENSER FOR VERTICAL AGITATOR

[75] Inventor: John A. Sundstrom, Springboro, Ohio

[73] Assignee: White Consolidated Industries, Inc., Cleveland, Ohio

[21] Appl. No.: 965,898

[22] Filed: Dec. 4, 1978

[51] Int. Cl.[2] ..... D06F 39/02
[52] U.S. Cl. ..... 68/17 A
[58] Field of Search ..... 68/17 A

[56] References Cited

U.S. PATENT DOCUMENTS

| | | | |
|---|---|---|---|
| 3,091,108 | 5/1963 | Martin et al. | 68/17 A |
| 3,306,084 | 2/1967 | Bullock | 68/17 A |
| 3,370,444 | 2/1968 | Wolters | 68/17 A X |

*Primary Examiner*—Philip R. Coe
*Attorney, Agent, or Firm*—Pearne, Gordon, Sessions

[57] ABSTRACT

A rinse agent dispenser assembly for use with an agitator for rotation and vertical reciprocation. The dispenser includes labryinth seals to retain the liquid rinse agent during vertical reciprocation of the agitator. The liquid agent retainer cup is designed to permit centrifugal discharge of the liquid agent at spin speeds. The three-part dispenser assembly is readily separated for easy cleaning.

2 Claims, 3 Drawing Figures

FABRIC SOFTENER DISPENSER FOR VERTICAL AGITATOR

This invention relates to a domestic appliance and, more particularly, to an improved means for dispensing a rinse agent such as a fabric softener therefrom at the conclusion of a spinning operation.

A centrifugally actuated dispenser of the type adapted for installation on the top of an agitator is taught in the patent to Martin et al U.S. Pat. No. 3,091,108, issued May 28, 1963, and Wolters U.S. Pat. No. 3,370,444, issued Feb. 27, 1968. This invention relates to an improved version of such a dispenser which is comprised of separable parts so they may be totally cleaned and which includes improved means for retaining the rinse agent therein during the reciprocation thereof.

Accordingly, it is an object of this invention to provide an improved combination agitator cap and centrifugally actuated rinse agent dispenser.

Another object of this invention is the provision of a centrifugally actuated rinse agent dispenser adapted for installation on a vertically reciprocable and rotatable clothes washer agitator and including a labyrinth seal formed by the cooperation of two of the separable parts for retaining the rinse agent therein during the vertical reciprocation thereof.

A still further object of this invention is the provision of a centrifugally actuated, vertically reciprocable dispenser comprising a three-part assembly held together by a cap which is removable for pouring rinse agent into the dispenser and for separating the parts either for cleaning all of the parts or for removing one of the parts for filling thereof remote from said dispenser.

Another object in accordance with the foregoing object is the provision that one of the three parts includes a separable rim, the radially inner and outer edges of which cooperate respectively with the other two parts, (1) to prevent leakage of rinse agent from the dispenser during rotation of the dispenser and (2) to facilitate the assembly of the three parts.

Further objects and advantages of the present invention will be apparent from the following description, reference being had to the accompanying drawings wherein preferred embodiments of the present invention are clearly shown.

IN THE DRAWINGS

Figure 1:
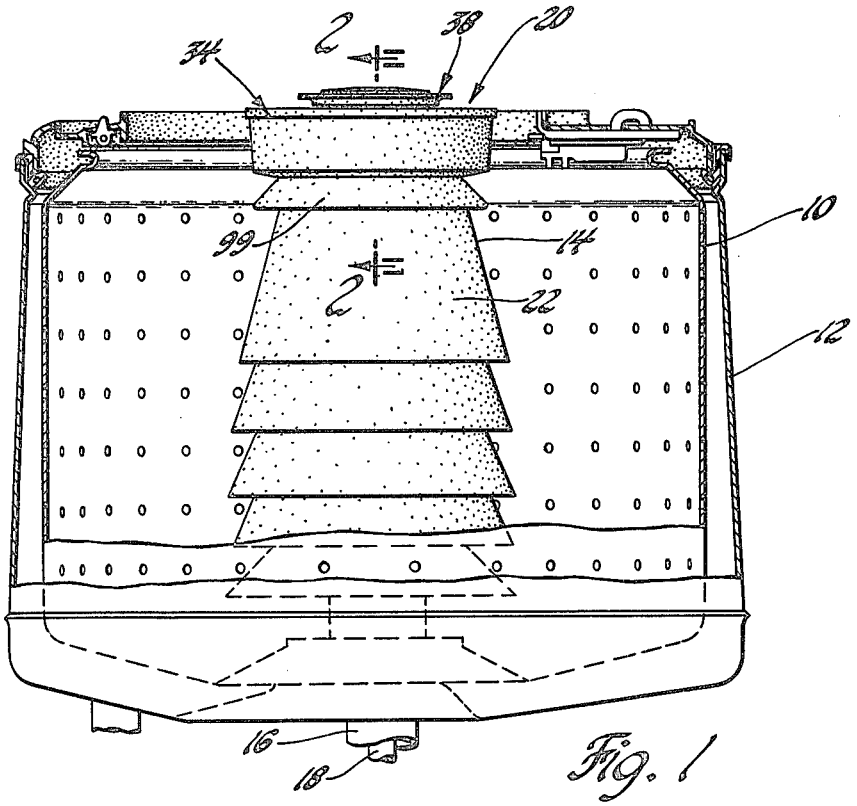
FIG. 1 is a fragmentary sectional view, partly in elevation, of a clothes washer spin tub and agitator provided with the dispenser of this invention.

In accordance with this invention FIG. 1 shows a fragmentary sectional view of a clothes washer preforate spin tub or basket 10 in an imperforate outer water container 12. An agitator 14 of the type taught in the U.S. Pat. No. 3,132,500 Bullock, issued May 12, 1964, is carried inside the spin tub 10 and an agitating and spinning mechanism (not shown) includes a spin shaft 16 connected to said spin tub for rotating said spin tub and an agitate shaft 18 connected to said agitator for vertically reciprocating the agitator 14. A roller drive mechanism of the type taught in the U.S. Pat. No. 3,087,321 Brucken, issued Apr. 30, 1963, may be adapted for rotating the spin shaft 16 and for vertically reciprocating the agitate shaft 18. The improved dispenser 20 of this invention is detachably supported on the top of the agitator 14. Dispenser 20 reciprocates and rotates with the agitator in accordance with the operation of the roller drive mechanism.

Figure 2:
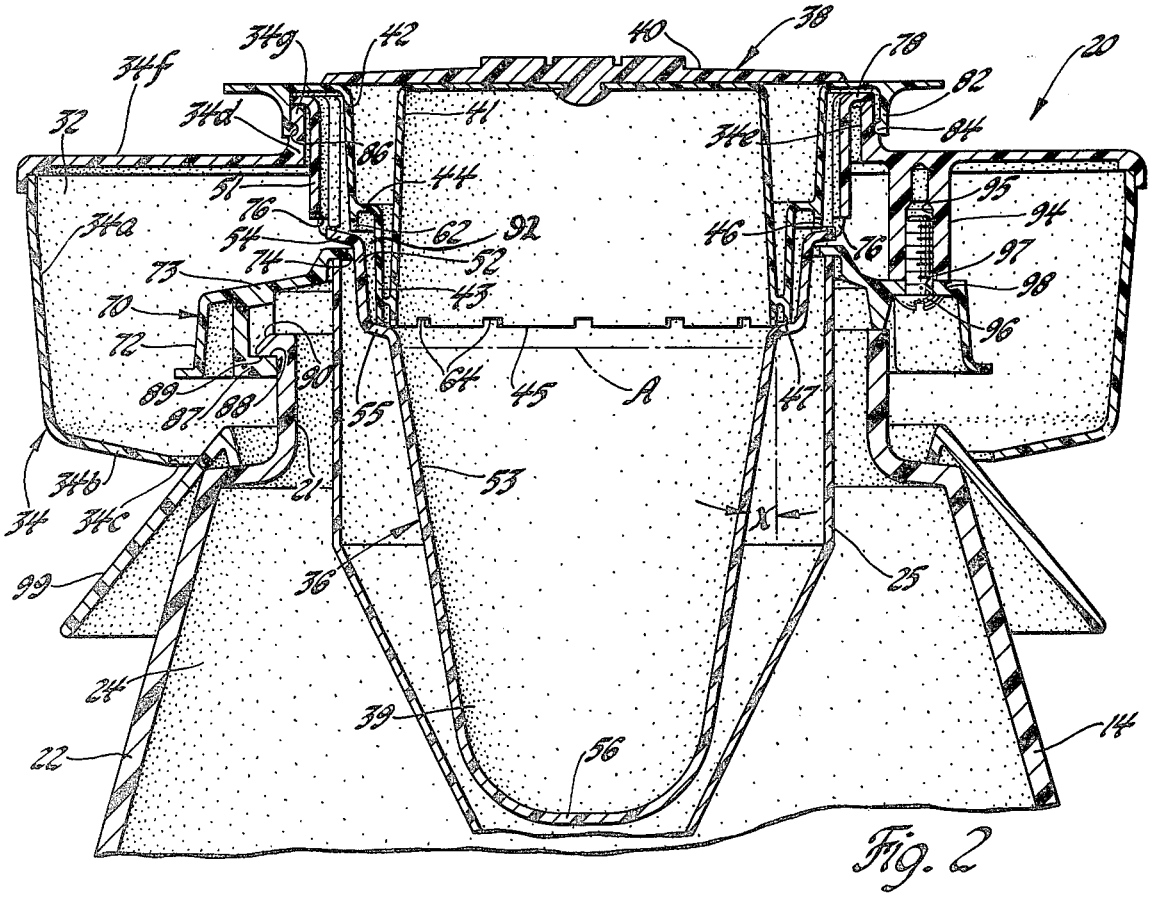
FIG. 2 is a sectional view taken along line 2—2 of FIG. 1.

Turning now to FIG. 2, rinse agent dispenser 20 is shown attached to the upper end of the cylindrical housing wall portion 21 of agitator cone 22 forming a hollow 24 in the agitator 14 for receiving an open top bleach cup 25 of the type taught in U.S. Pat. No. 3,306,084 to Bullock, issued Feb. 28, 1967. The dispenser 20 is particularly adapted for use with clothes washers having lower spin speeds during cool-down and is adapted to centrifugally release its charge at speeds of 350–400 r.p.m.

The dispenser 20 is comprised of an outer container portion or dispensing compartment forming means 34 having peripheral L-sectional wall or annulus including peripheral wall portion **34*a* and an inwardly directed bottom 34*b* defining an agitator receiving agent dispensing opening 34*c*. The peripheral wall portion 34*a* is 194.0 millimeters (mm) in diameter by 51.0 mm deep exclusive of its upstanding collar 34*d* extending 9.50 mm above top 34*f* of the container portion 34. A liquid storage portion or inner chamber forming means, generally indicated at 36, is sized for nested relation in compartment forming means 34 with both elements 34 and 36 being formed of polypropylene or other suitable material. A cap forming means, generally indicated at 38, is adapted to close upper collar opening 34*e*, 94.6 mm in diameter, of the outer container 34 and through which opening 34*e* a rinse agent, fabric softener or other liquid wash agent is placed in the dispenser. When the liquid container portion 36 and the outer container portion 34 are nested, a central frustoconical-shaped cup-like inner storage chamber 39 and a substantially coaxial radially inwardly opening annulus or dispensing compartment 32 are formed which communicate with each other during a wash spin of tub 10** in a manner to be described below.

Figure 3:
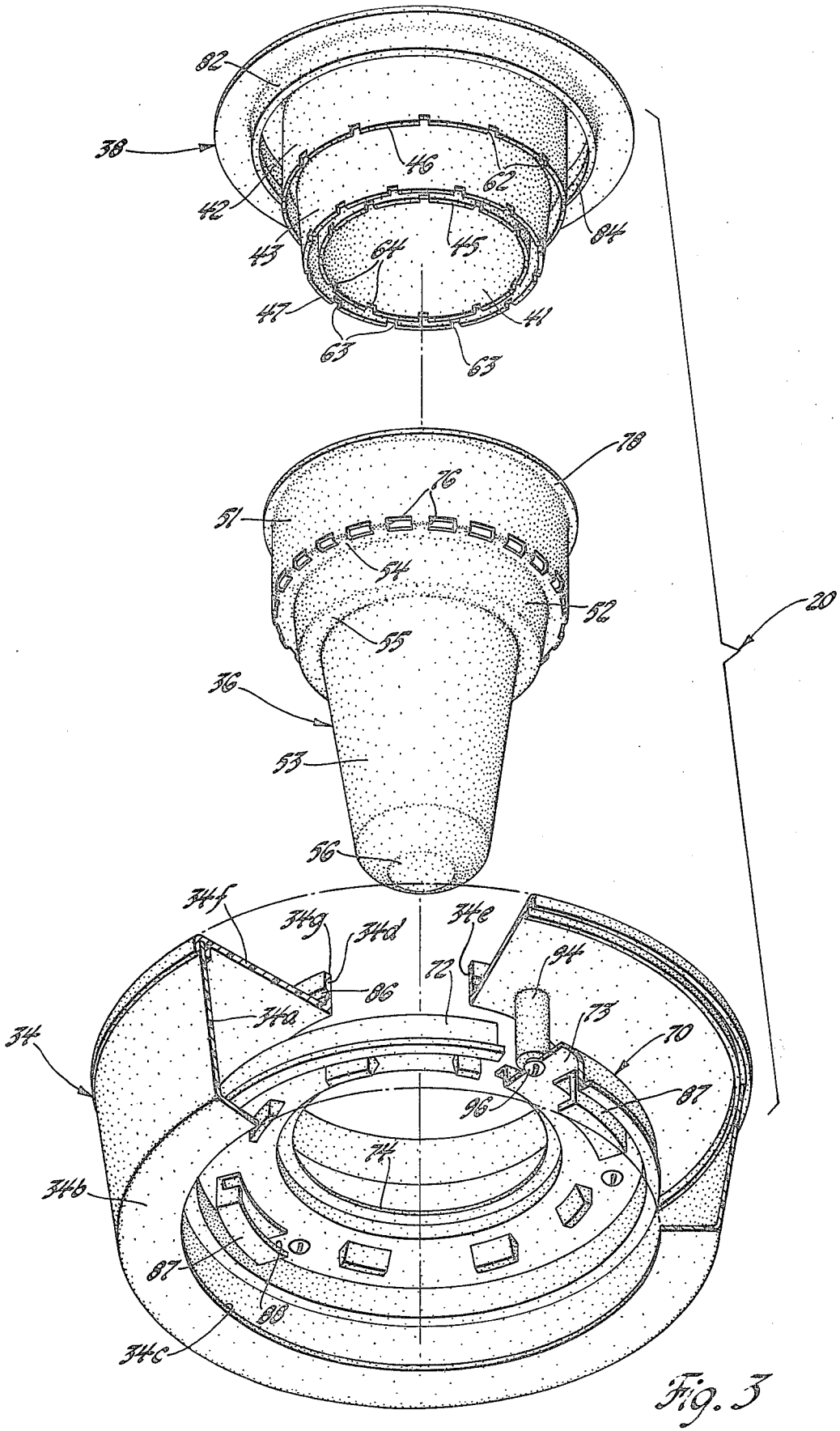
FIG. 3 is an exploded view of the three-part assembly of the dispenser.

As best seen in FIGS. 2 and 3, the cap forming means 38 includes an upper cap 40 including a radially inner flange or skirt 41 and a radially outer concentric stepped flange or skirt depending from the underside of the cap. The outer stepped skirt includes a cylindrical upper skirt portion 42 and a cylindrical lower skirt portion 43 interconnected by a substantially flat shoulder 44. In the form shown the inner skirt 41 includes a depending lower rim or edge 45 having a diameter of about 64.00 mm, its upper skirt portion 42 includes a depending lower rim or edge 46 having a diameter of about 82.00 mm, and its lower skirt portion 43 includes a depending lower rim or edge 47 having a diameter of about 71.00 mm.

With reference to FIGS. 2 and 3, the chamber forming means 36 provides a cylindrical upper wall 51, a cylindrical intermediate wall 52 and a cylindrical lower stepped wall 53. Such walls are progressively reduced diameters relative to the wall next above. Walls 51 and 52 are interconnected by an upper bevel shoulder or ledge 54, while walls 52 and 53 are connected by a lower bevel shoulder or ledge 55. The storage chamber 39 is defined by the lower wall 53 of the removable chamber forming means or cup 36. Thus, during use a predetermined quantity of liquid treating agent, such as a fabric softener, is poured into the storage chamber 39 and diluted with water to a selected level which at its maximum will achieve a fill level "A" below the lower ledge 55. It will be appreciated that by virtue of the chamber forming means or cup 36 being separable it can be removed from the outer container 34 by the operator when filling, if desired. The cup upper wall 51 has a diameter of about 93.70 mm, the cup intermediate wall has a diameter of about 76.00 mm and the cup frustoconical shaped lower wall 53 has a miximum diameter at its upper end of about 64 mm with lower shoulder or ledge 55 located a vertical distance of about 81.0 mm above the base wall 56 of the cup-like storage chamber 39. Thus, in the preferred form the storage chamber lower wall 53 forms an angle "X" of about 10° for a reason to be explained below.

In the construction illustrated, FIG. 3 shows the upper skirt portion 42 provided with a plurality or series of equally spaced slots or passageways 62 formed in the lower edge 46. In a similar manner the lower skirt portion 43 and inner skirt 41 each have a plurality or series of equally spaced slots or passageways 63 and 64 formed in the lower edges 47 and 45 respectively, in an offset or staggered manner. In the embodiment shown each series of passageways 62, 63 and 64 total twelve in number and are 1.50 mm high by 3.00 wide.

It will be seen in FIGS. 2 and 3 that the container forming means 34 partially defines the inner opening annulus 32 the inner limits of which are defined by a cylindrical agitator support 70 having an outer rim 72 and an inner sloped trunk 73 located in concentric fashion intermediate outer peripheral wall 34*a* and the stepped walls 52, 53. The rim 72 circumscribes the circumferential annulus cavity or dispensing compartment space 32 internally thereof to define therewith an inlet to, and an outlet from, the dispensing compartment 32. The inlet to the annulus or dispensing compartment 32 is delineated between the upper collar opening 34*e* and trunk central opening 74 sized to receive the intermediate stepped wall 52. A plurality of outflow ports 76 are formed in the juncture of upper stepped wall 51 and upper ledge 54. Thus, upon the trunk opening 74 telescopically receiving the removable cup 36 sufficiently into the outer container 34 to position cup outwardly directed peripheral lip 78 on the outer container collar 34*d* upper edge 34*g* with the outflow ports 76 located adjacent the annulus or dispensing compartment inlet. In the form shown twenty 9.50 mm by 1.88 mm outflow ports 76 are provided in the cup 36.

It will be seen in FIG. 2 that the cap 40 includes a cylindrical depending peripheral element 82 formed with an inwardly projecting arcuate protrusion 84 adapted to be snappingly received in a conforming annular collar groove 86. Thus, as shown in FIG. 2 the interlocking releasable protrusion 84 and groove 86 provide means to removably retain the cap forming means 38 in assembled relation with the outer container portion 34 and cup 36 for retaining the liquid rinse agent in storage chamber 39 during reciprocation of the dispenser 20.

The dispenser 20 is adapted for installation on the top of the agitator 14 which is reciprocable. In the form shown the support trunk 73 has L-sectioned arcuate locking members 87 depending from the underside thereof defining inclined surfaces 88 which are cammed into locking engagement with the underside 89 of cooperating arcuate tangs 90 spaced around the periphery of the agitator post cylindrical wall portion 21 in a conventional manner. It will be noted in FIGS. 2 and 3 that a plurality of circumferentially spaced integral bosses 94 are formed on the underside of wall 34*f* having bores 95 with each bore receiving a threaded fastener 96 extending through aligned apertures 97 in the trunk flat portions 98 of support trunk 73.

As discussed in the mentioned Wolters U.S. Pat. No. 3,370,444 patent, vertically shaking a dispenser on agitator 14 gives rise to the problem of retaining the rinse agent during reciprocation of the agitator and, to solve this problem, the dispenser 20 is provided with the plurality of circumferentially offset lower notches 63 and 64 which together with lower edge 47 being in sufficiently close proximity with wall means, in the form of lower beveled shoulder 55, interrupt communication so as to partially block the circumferential space 32 in a labryinth seal manner.

In a similar manner a labyrinth seal is formed by the cup forming means lower edge 46 extending telescopically into the cup 36 in sufficiently close proximity to the wall means, in the form of beveled shoulder 54, and below the outflow ports 76 to interrupt communication between the cup storage chamber 39 and the outer dispensing compartment 32 of container 34 during reciprocation of the dispenser 20. It will be appreciated that this is achieved without interrupting communication between the storage chamber 39 and the dispensing compartment 32 rotation of the dispenser 20 with the agitator 14 and spin tub 10. Thus, during agitate the diluted softener remains in storage chamber 39, held there by the upper and lower labyrinth seals during the vertical shaking action of the dispenser.

During the wash spin of the tub 10, the liquid softener moves up the frustoconical wall 53 portion of the cup 36 and out through the lower notches 63 and 64 into the cavity 92 due to centrifugal force. It will be noted that the slope angle "X" of cup wall 53 is such that a spin speed of about 350–400 revolution per minute (rpm's) is required to generate sufficient centrifugal force to move the softener up the cup angled wall 53. The result is that the liquid softener in storage chamber 39 is unable to exit the notches 63 and 64 during "cooldown" of the permanent press and knit washing cycles of washer because the tub 10 spin speed is limited to the range of about 100 to 150 rpm's as a consequence of the spin tub "dragging" or being slowed by the water retained in the outer container 12 at a predetermined level.

The wash spin centrifugal force further causes the liquid softener to exit the cavity 92 via the upper notches or passages 62 and flow out of the cup ports 76 into annulus or dispensing compartment 32. By virtue of the channel-sectioned compartment 32, defined by wall portions 34*a* and 34*b*, the softener is retained at the outer diameter of the dispensing compartment 32 during the remainder of the wash spin because of the centrifugal force.

Upon the termination of the wash spin cycle, gravitational force causes the softener to flow inwardly over wall portion 34*b* and exit the opening 34*c* for flow down the face of upper cone portion 99 where the softener is further diluted and washed down by the action of the rinse fill water entering the tub 10.

While the embodiment of the present invention as herein disclosed constitutes a preferred form, it is to be understood that other forms might be adopted.

The embodiments of the invention in which an exclusive property or privilege is claimed are defined as follows:

1. In a rinse agent dispenser adapted for mounting on an agitator for rotation and vertical reciprocation therewith and including an open top storage chamber for receiving and containing a rinse agent and having outflow ports above upwardly diverging wall means therein for releasing said rinse agent from said storage chamber by centrifugal force during rotation of said dispenser, means forming a dispensing compartment radially outwardly from said storage chamber and in continuous communication therewith through said outflow ports for receiving and retaining the rinse agent released from said storage chamber and for releasing said rinse agent at the close of said dispenser rotation, and a cap for covering the open top of said storage chamber and removable therefrom for filling said storage chamber with rinse agent, the improvement comprising a separable, three-part assembly including said cap, said storage chamber and said dispensing compartment, said dispensing compartment being in the form of an outer container and said storage chamber being in the form of a removable cup with a lip defining its open top, said outer container defining a radially inwardly opening annulus with a rim circumscribing the annulus internally thereof to define therewith an inlet to and an outlet from said dispensing compartment, said rim having an opening for telescopically receiving said cup sufficiently into said outer container to position the lip of said cup on said outer container with said outflow ports adjacent the inlet to said outer container, and means on said cap for retaining said rinse agent in said storage chamber during reciprocation of said dispenser, said retaining means cooperating with the wall means of said storage chamber to form a labyrinth seal by extending telescopically into said cup in sufficiently close proximity to said wall means below said outflow ports to interrupt communication between said storage chamber and said outer container during reciprocation of said dispenser without interrupting communication between the storage chamber and said outer container during rotation of said dispenser, said cap being fastenable to said outer container in a manner to sandwich said lip between the cap and outer container while forcing said retaining means into cooperating proximity to said wall means for holding the three parts in assembled relationship and being user removable therefrom to permit separation of said three-part assembly for easy cleaning of each part thereof and for convenient removal of said cup to permit filling of said storage chamber remote from said dispenser assembly.

2. In a rinse agent dispenser adapted for mounting on an agitator for rotation and vertical reciprocation therewith and including an open top storage chamber for receiving and containing a rinse agent and having outflow ports above upwardly diverging wall means therein for releasing said rinse agent from said storage chamber by centrifugal force during rotation of said dispenser, means forming a dispensing compartment radially outwardly from said storage chamber and in continuous communication therewith through said outflow ports for receiving and retaining the rinse agent released from said storage chamber and for releasing said rinse agent at the close of said dispenser rotation, and a cap for covering the open top of said storage chamber and removable therefrom for filling said storage chamber with rinse agent, the improvement comprising a separable assembly including said cap, said storage chamber and said dispensing compartment, said dispensing compartment being in the form of an outer container and said storage chamber being in the form of a removable cup with a lip portion defining its open top and a pair of concentric, vertically spaced shoulders interconnecting said lip portion and said upwardly diverging wall means below said outflow ports, said outer container comprising two pieces one of which defines a radially inwardly opening annulus and the other of which defines a rim circumscribing the annulus internally thereof to define therewith an inlet to and an outlet from said dispensing compartment, said rim having an opening for telescopically receiving said cup sufficiently into said outer container to position the lip portion of said cup on said outer container with said outflow ports adjacent the inlet to said outer container, and means on said cap for retaining said rinse agent in said storage chamber during reciprocation of said dispenser, said retaining means being defined as a pair of concentric, vertically spaced cylinders cooperating respectively with the pair of vertically spaced shoulders of said storage chamber to form a labyrinth seal by extending telescopically into said cup in sufficiently close proximity to said shoulders below said outflow ports to interrupt communication between said storage chamber and said outer container during reciprocation of said dispenser, said cylinders when extended into said cup having a plurality of peripherally spaced notches therearound at said shoulders so that communication between the storage chamber and said outer container is not interrupted during rotation of said dispenser, said cap being fastenable to said outer container in a manner to force said cylinders into close proximity to said shoulders and for holding the assembly together and being user removable from said outer container to permit separation of said assembly regularly for easy cleaning of each part thereof including said notches and for convenient removal of said cup to permit filling of said storage chamber remote from said dispenser assembly, said rim having a peripheral ledge on the opposite side thereof from its opening to facilitate the movement of said rinse agent due to centrifugal force from said storage chamber to said annulus so that the rinse agent will not be dispensed from said dispensing compartment prematurely due to gravity before the close of dispenser rotation, said rim having a radially outer dimension just small enough to permit the insertion thereof into the radially inner opening of the annulus for assembly therewith and to permit separation occasionally therefrom for cleaning.

* * * * *